US009404211B2

(12) United States Patent
Hill et al.

(10) Patent No.: US 9,404,211 B2
(45) Date of Patent: Aug. 2, 2016

(54) SEQUENCED WATER DELIVERY IN AN ADDITIVE DISPENSER

(71) Applicant: Electrolux Home Products, Inc., Cleveland, OH (US)

(72) Inventors: Chris H. Hill, Ames, IA (US); Jason D. Miller, Alden, IA (US); Stefano De Paoli, Fiume Veneto (IT); Fabio Marchetto, Oderzo (IT)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 14/794,961

(22) Filed: Jul. 9, 2015

(65) Prior Publication Data

US 2015/0315738 A1 Nov. 5, 2015

Related U.S. Application Data

(62) Division of application No. 11/939,103, filed on Nov. 13, 2007, now Pat. No. 9,085,844.

(51) Int. Cl.
*D06F 39/08* (2006.01)
*D06F 39/02* (2006.01)

(52) U.S. Cl.
CPC ..... *D06F 39/028* (2013.01); *D06F 39/02* (2013.01)

(58) Field of Classification Search
CPC ..... D06F 39/028
See application file for complete search history.

(56) References Cited

U.S. PATENT DOCUMENTS

| | | | |
|---|---|---|---|
| 3,088,305 | A | 5/1963 | Ohmann |
| 3,124,271 | A | 3/1964 | Beck et al. |
| 3,757,543 | A | 9/1973 | Braga |
| 5,253,494 | A | 10/1993 | Frucco et al. |
| 6,463,766 | B2 | 10/2002 | Kubota et al. |
| 6,826,933 | B2 | 12/2004 | Merkle et al. |
| 7,093,467 | B2 | 8/2006 | Kim et al. |
| 7,427,239 | B2 | 9/2008 | Hocknell et al. |
| 2004/0011089 | A1 | 1/2004 | Rizzeto et al. |
| 2004/0103696 | A1 | 6/2004 | Kim et al. |
| 2005/0155633 | A1 | 7/2005 | Daume et al. |
| 2005/0166645 | A1 | 8/2005 | Favret et al. |
| 2005/0188729 | A1 | 9/2005 | Zsambeki et al. |
| 2005/0188730 | A1 | 9/2005 | Zsambeki |
| 2005/0210927 | A1 | 9/2005 | Kim et al. |
| 2005/0224098 | A1 | 10/2005 | Fujii et al. |
| 2005/0229645 | A1 | 10/2005 | Kim et al. |
| 2005/0229652 | A1 | 10/2005 | Kim et al. |

(Continued)

FOREIGN PATENT DOCUMENTS

| | | | |
|---|---|---|---|
| CN | 1715521 | A | 1/2006 |
| CN | 1715522 | A | 1/2006 |

(Continued)

*Primary Examiner* — Michael Barr
*Assistant Examiner* — Jason Riggleman
(74) *Attorney, Agent, or Firm* — Banner & Witcoff, LTD.

(57) ABSTRACT

An automatic washing machine includes a wash additive dispenser for dispensing detergent and one or more additives into a wash tub. Water is delivered to a first wash agent chamber in the wash additive dispenser for delivery into a wash tub during a wash cycle. Water is subsequently delivered to a second wash agent chamber to flush from that chamber any unintended collection of water or additive residue therein, as may result from the water delivery to the first wash agent chamber and/or from an earlier dispensing of additive from the second wash agent chamber.

17 Claims, 6 Drawing Sheets

(56) References Cited

U.S. PATENT DOCUMENTS

| | | | |
|---|---|---|---|
| 2005/0235703 | A1 | 10/2005 | Cho et al. |
| 2005/0235704 | A1 | 10/2005 | Cho et al. |
| 2005/0241347 | A1 | 11/2005 | Cho et al. |
| 2005/0252251 | A1 | 11/2005 | Rizzetto |
| 2005/0262881 | A1 | 12/2005 | Rizzetto |
| 2005/0274156 | A1 | 12/2005 | Yang |
| 2006/0144424 | A1 | 7/2006 | Marchitto et al. |
| 2007/0056328 | A1 | 3/2007 | Song |
| 2007/0056329 | A1 | 3/2007 | Song |
| 2007/0056330 | A1 | 3/2007 | Song |
| 2007/0079637 | A1 | 4/2007 | Song |

FOREIGN PATENT DOCUMENTS

| | | | | | |
|---|---|---|---|---|---|
| DE | 3637815 | A1 | | 6/1987 | |
| DE | 29801248 | U1 | | 7/1999 | |
| EP | 0318070 | A1 | | 5/1989 | |
| EP | 0318070 | | | 9/1989 | |
| EP | 1449952 | A1 | | 8/2004 | |
| EP | 1688529 | A1 | | 8/2006 | |
| FR | 2530687 | A3 | | 1/1984 | |
| FR | 2632984 | A1 | | 12/1989 | |
| GB | 2141487 | A | | 12/1984 | |
| GB | 2187764 | A | | 9/1987 | |
| GB | 2297561 | A | | 8/1996 | |
| GB | 2297561 | A | * | 8/2006 | ..... D06F 39/08 |
| JP | 63171592 | | | 7/1988 | |
| JP | 63270098 | | | 11/1988 | |
| JP | 2174898 | | | 7/1990 | |
| JP | 3215296 | | | 9/1991 | |
| JP | 10127982 | | | 5/1998 | |
| JP | 11347291 | | | 12/1999 | |
| JP | 2000342894 | A | | 12/2000 | |
| KR | 2005022626 | | | 3/2005 | |
| KR | 1020050022626 | | | 3/2005 | |
| KR | 2005036537 | | | 4/2005 | |
| KR | 2006100617 | | | 9/2007 | |
| KR | 2003009847 | | | 1/2008 | |

* cited by examiner

SEQUENCED WATER DELIVERY IN AN ADDITIVE DISPENSER

CROSS-REFERENCE TO RELATED APPLICATIONS

This application is a divisional of U.S. patent application Ser. No. 11/939,103, filed Nov. 13, 2007, and titled "Sequenced Water Delivery in an Additive Storage Chamber," the disclosure of which is herein incorporated by reference in its entirety.

BACKGROUND

Automated washing machines (such as laundry washing machines) often include mechanisms for dispensing additives into a washing chamber (e.g., a drum of a laundry washing machine). Some dispensers contain receptacles or chambers for different additives, which can include detergents, whiteners, fabric softeners, scents, rinse aids, etc. Typically, a user fills a dispenser chamber with one or more additives. During a wash cycle, water is then automatically introduced into the dispenser chamber and mixes with the additive. The water/additive mixture then flows into a separate washing chamber. Filling a first dispenser chamber with water or other liquid may, in some instances, cause unintentional water flow into a second dispenser chamber. This gives rise to the undesirable situation of a user encountering liquid in a chamber of the dispenser the next time a user uses the washing machine and needs to add more detergent or other additives.

BRIEF SUMMARY OF SELECTED INVENTIVE ASPECTS

Aspects of the invention provide a system and method for evacuating one or more additive chambers in a washing device so as avoid the above situation. A washing device such as a laundry washing machine may include multiple cycles involving multiple additives. Each additive may be stored in a separate chamber or compartment in an additive dispenser drawer. Water may be injected into each additive chamber, as needed, to mix with the additive and to cause delivery of same into a wash basin or tub. To avoid an unintentional collection of water in one chamber that may result when filling a second additive chamber, water may be injected into first additive chamber to flush out any residual water or additive residue (e.g., via a siphoning effect). The water may be flowed into the first additive chamber after the second additive chamber has dispensed its contents. For example, a detergent contained in a detergent chamber may be dispensed during a main wash cycle. Subsequently, a fabric softener additive may be dispensed from a softener dispenser during a rinse cycle. After the fabric softener additive has been dispensed, a second flow of water may be directed to the detergent chamber to flush out any water or residue therein. The second flow of water may be used to fill the detergent chamber to a level where siphoning takes hold in order to flush the chamber.

This summary is provided to introduce a selection of concepts of the inventive subject matter that are further described below in the detailed description. This summary is not intended to identify essential features or advantages of the claimed subject matter, nor is it intended to be used to limit the scope of the claimed subject matter. Additional features and advantages of various embodiments are further described below.

BRIEF DESCRIPTION OF THE DRAWINGS

Aspects of the invention are illustrated by way of example and not by limitation in the accompanying figures in which like reference numerals indicate similar elements and in which.

DETAILED DESCRIPTION OF EXEMPLARY EMBODIMENTS

Although various embodiments are described herein using a front-loading clothes washing (or laundry) machine as an example, the invention is not limited to front loading washers. In other embodiments, additive dispensers similar to those described herein are incorporated into top loading washing machines. The invention is not limited to laundry equipment. Additive dispensers similar to those described herein can also be used in automated dishwashing equipment, as well as in other devices. Indeed, dispensers such as those described herein can be used in devices that perform no washing function.

Figure 1:
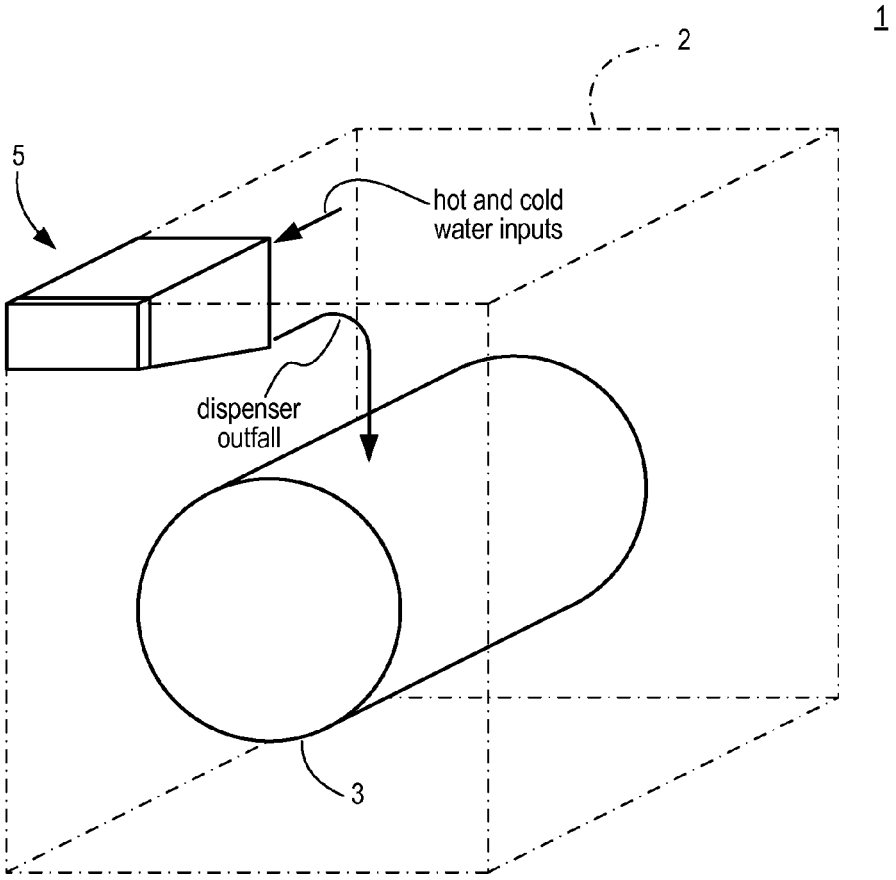
FIG. 1 is a partially schematic front perspective view of a washing machine according to some embodiments.

FIG. 1 is a partially schematic front perspective view of a clothes washing machine 1 according to at least some embodiments. The housing 2 of washing machine 1 is shown with uneven broken lines, and numerous details of washing machine 1 have been omitted so as not to obscure this description with unnecessary details. As seen in FIG. 1, washing machine 1 is of the front-loading type. Clothes or other items to be laundered are placed into a drum 3. Drum 3 is then rotated during various portions of a wash cycle by a motor (not shown). In the embodiment of FIG. 1, hot and cold water inputs are fed to a dispenser 5. The outfall from dispenser 5 then flows into drum 3. Within or associated with dispenser 5, one or more electrically-controlled valves and/or flow channels are used to direct water into drum 3. During some parts of the cycle, water bypasses various additive chambers within dispenser 5, and the outfall from dispenser 5 is water alone. During other parts of a wash cycle, and as described in more detail below, water flows through one or more chambers within dispenser 5 and mixes with additives in those chambers. As a result of said mixing, the outfall from dispenser 5 is a combination of water and one or more of the additives. The outfall may be facilitated by one or more hoses, valves and/or nozzles connecting dispenser 5 and drum 3. During (or at the conclusion of) each wash cycle, water is drained from drum 3 via a drain line (not shown).

In use, after placing a load of laundry in the wash basin or tub of drum 3, a user may fill dispenser 5 with a suitable type and quantity of laundry detergent, pre-wash, bleach, fabric softener and the like. The structure and operation of dispenser 5 is discussed in further detail below. A wash process may then be initiated by an operator, e.g., through interaction with a control panel (not shown). The process typically begins with a wash basin fill cycle, wherein water enters the wash basin via an inlet hose, valve and/or nozzle (not shown). In one scenario, water is initially delivered into one or more compartments of dispenser 5 (e.g., via an inlet hose) before reaching the wash basin. This allows the water to mix with the appropriate wash additive (e.g., detergent or pre-wash in the beginning stages of a wash cycle) prior to delivery into the wash basin.

Water or a mixture of water and one or more additive from dispenser 5 may then fill the wash basin of drum 3 to a predetermined level, which may be varied, e.g., according to a user setting and/or depending upon the size of the wash load. Once the appropriate/set level is reached, the water supply valve is closed and the washer enters a wash cycle comprising a number of sequential stages. For example, the wash cycle may include intermittent rotation of drum 5 (and a wash basin therein) in various directions (e.g., clockwise and counter-clockwise). The speed, duration and direction of rotation may be pre-defined based upon a desired wash type (e.g., delicate, normal, etc.).

Upon completion of the wash cycle, a static drain of the wash liquid from the wash basin is carried out via a drain pipe. Once the free wash liquid (liquid not absorbed into the wash load) pooled within the wash basin is drained, a spin cycle is initiated wherein the wash basin is rotated at a high rate of speed. This rotation of drum 3 and the wash basin forces wash liquid absorbed into the wash load out of the load, and out of the wash basin through, e.g., one or more apertures formed in the walls of the wash basin. The wash load may then be subjected to another rinse cycle, in which the water supply valve is again opened to allow fresh water to enter the wash basin. The wash basin is again rotated to generate a vigorous rinse action and the static and spin drain cycles outlined above are repeated. In one or more configurations, the rinse cycle may include the delivery of fabric softener or other post-wash additives into the wash basin. In such configurations, the fabric softener or other additives may be rinsed out of the wash load according to the rinse and spin cycles described herein.

Figure 2:
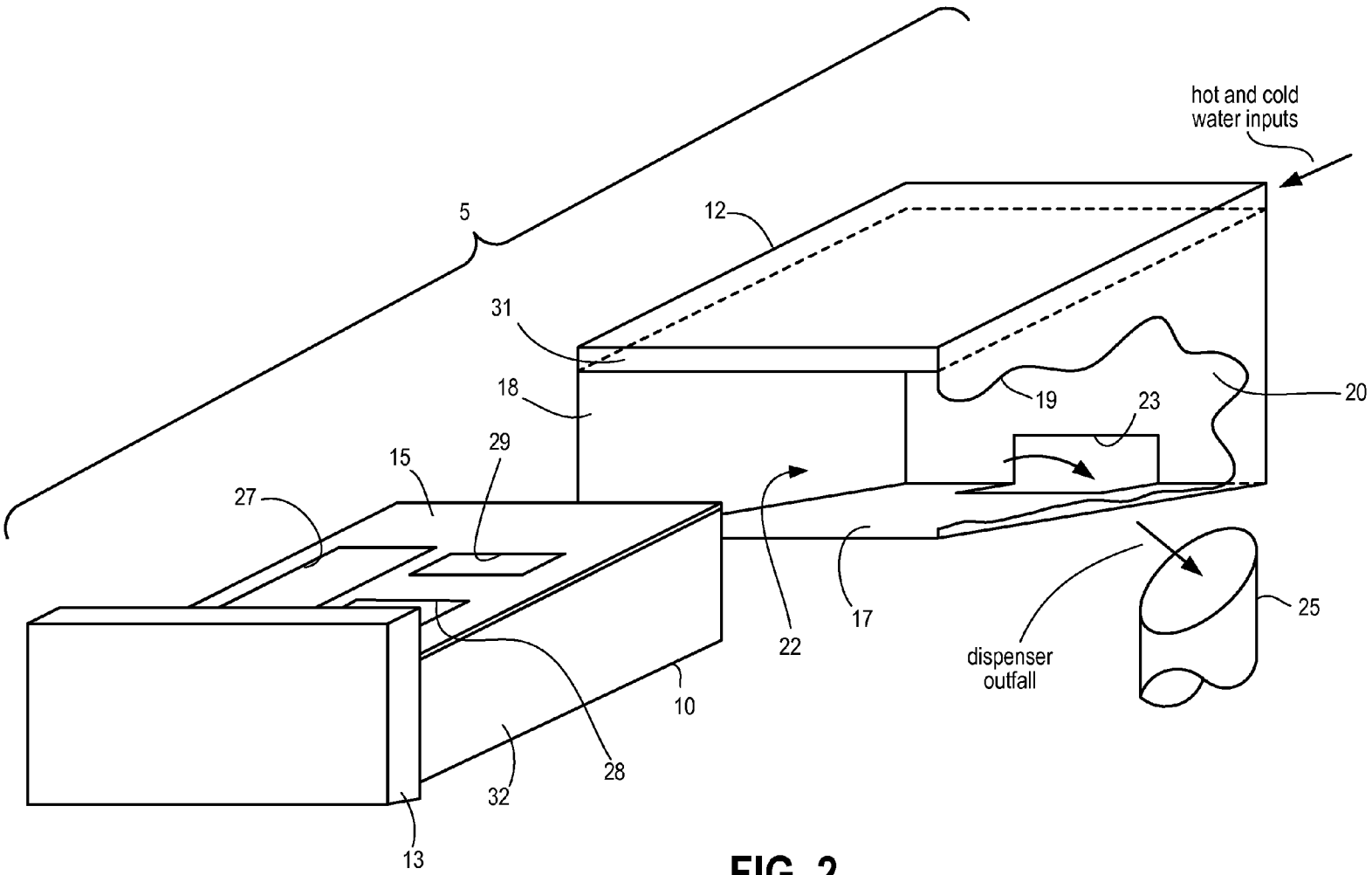
FIG. 2 is a perspective view showing an additive dispenser from the washing machine of FIG. 1.

FIG. 2 illustrates dispenser 5 in further detail. Dispenser 5 includes a drawer 10 and drawer compartment 12. Drawer 10 is attached to a front panel 13 and includes a removable cover 15. Drawer compartment 12 includes a bottom 17, sides 18 and 19, and a rear 20. Side 19 is partially removed in FIG. 2 so as to show additional internal details. Drawer 10 and cover 15 slide into a cavity 22 formed by sides 18 and 19, bottom 17, and rear 20. With the exception of a drain region 23, the inner surfaces of sides 18 and 19, bottom 17 and rear 20 are fluid tight. When water is introduced into drawer 10 (as described below), water and/or additive flows from the rear of drawer 10. Because bottom 17 slopes downward, water and/or additive from drawer 10 flows into drain region 23. Drain region 23 is connected to an outfall tube 25 that carries water and/or additive to drum 3 (see FIG. 1).

Three separate chambers are formed in drawer 10. One of the chambers may hold and dispense powdered detergent, and the other two chambers may hold and dispense liquid additives (e.g., fabric softener and bleach). Openings corresponding to each of the three chambers in drawer 10 are formed in cover 15. Specifically, a first opening 27 is positioned over the chamber used to hold and dispense powdered detergent. Liquid detergent may also be dispensed through the use of an insertable cup and cover assembly. A second opening 28 is positioned over the chamber used to hold and dispense fabric softener, and a third opening 29 is positioned over the chamber used to hold and dispense liquid bleach.

Figure 3:
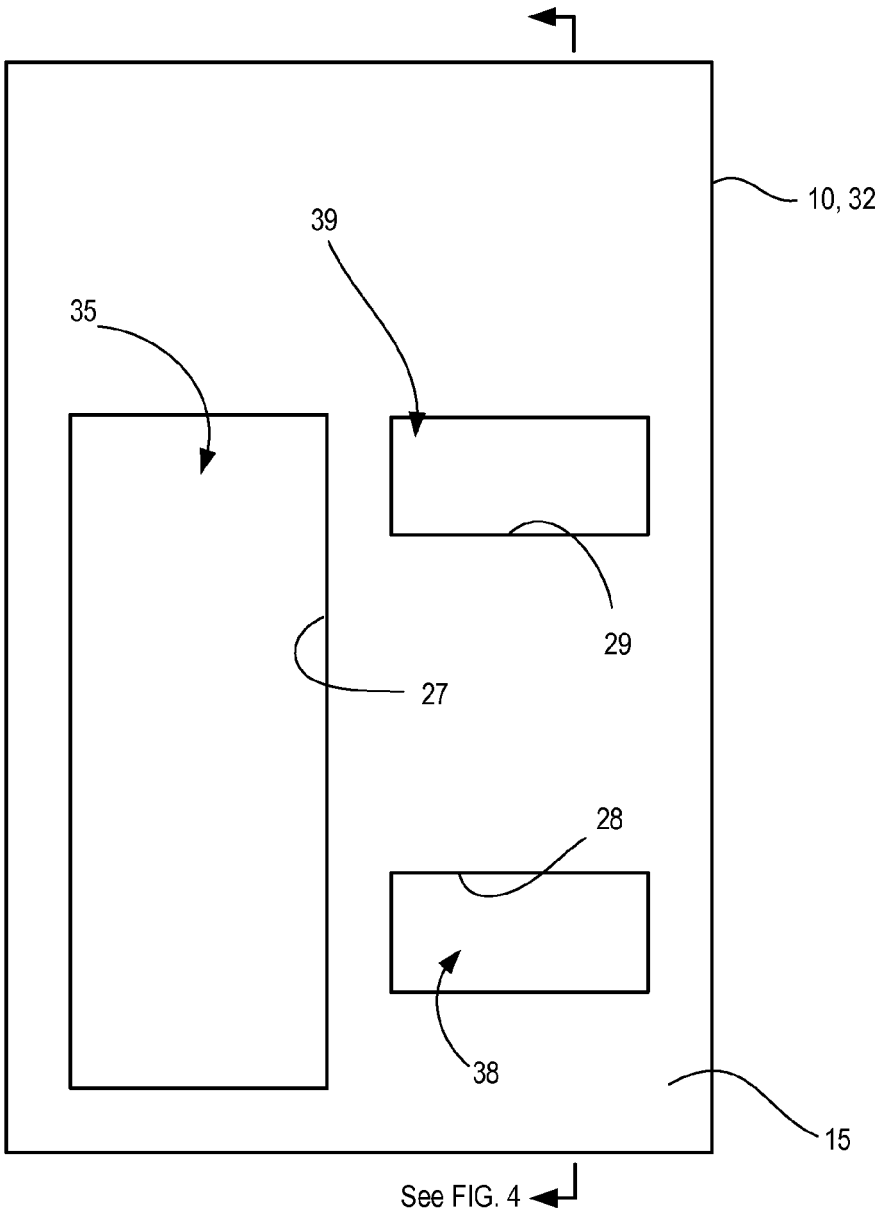
FIG. 3 is a top view of a drawer from the dispenser of FIG. 2.

When drawer 10 and cover 15 are fully inserted into drawer compartment 12 (as shown in FIG. 1), a water flow control assembly 31 selectively introduces water into one or more of openings 27, 28 and 29. Water flow control assembly 31 is also configurable (e.g., during a rinse cycle) to bypass drawer 10 by directing water between the left side of drawer 10 (i.e., the side not visible in FIG. 2 and that is opposite to right side 32) and the inner surface of side 18 of drawer compartment 12. In some embodiments, water flow control assembly 31 includes a water conveying tray with groups of holes that are positioned over openings 27, 28 and 29 when drawer 10 and cover 15 are inserted into drawer compartment 12, as well as a group of holes located over the region between the left side of drawer 10 and the inner surface of compartment side 18. A plurality of channels are also formed in the water conveying tray so as to direct water over an appropriate group (or groups) of holes for dispensing a selected additive during a particular wash cycle. Solenoid valves are coupled to the hot and cold water inputs, and are selectively operated (either individually or in various combinations) so as to direct water through the appropriate channel(s). Such water flow control assemblies are known in the art. One example of a tray-type water flow control assembly having a plurality of channels and hole groupings is described in U.S. Pat. No. 6,227,012 (titled "Device for Housing Detergents and/or Other Washing Agents Which Can Be Used in a Washing Machine, Preferably in a Machine for Washing Laundry"). In other embodiments, different water control mechanisms can be used. For example, a separate tubing output could be placed in each of the locations within drawer compartment 12 that corresponds to one of openings 27, 28 and 29 and to the drawer bypass location, with a separate solenoid valve placed in a fluid flow path between each tubing output and the hot and/or cold water inputs. FIG. 3 illustrates a top view of drawer 10.

Figure 4:
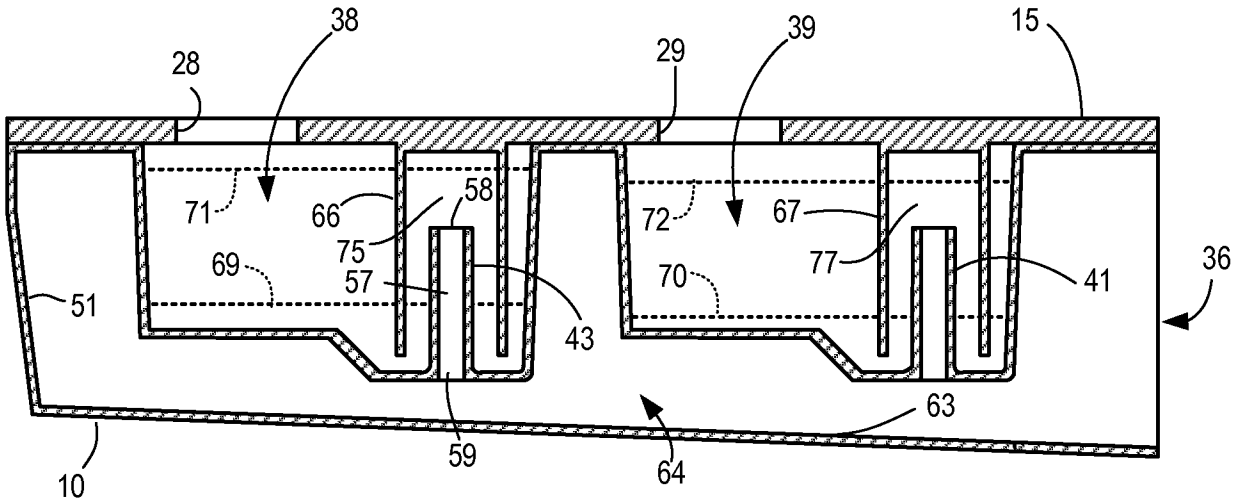
FIG. 4 is a cross-sectional view taken from the location indicated in FIG. 3.

FIG. 4 is a cross-sectional view taken from the location shown in FIG. 3, and shows drawer 10 with cover 15 in place. A cap 66 is attached to the underside of cover 15 and is positioned over siphon post 43. A cap 67 (also attached to the underside of cover 15) is positioned over siphon post 41. Chambers 38 and 39 are used to hold and dispense liquid additives. In the embodiment shown, chamber 38 is used to hold and dispense relatively viscous fluid additives (e.g., fabric softener). Chamber 39 is used to hold and dispense less viscous additives (e.g., liquid bleach). In operation, a user pours liquid additives into chambers 38 and 39 through openings 28 and 29 when drawer 10 and attached cover 15 are pulled outwardly to extend from drawer compartment 12. By way of example, broken lines 69 and 70 indicate the fill levels of fabric softener (chamber 38) and bleach (chamber 39) added by a user. Actual indicia indicating a desirable fill level may be provided, but are not required. Rather, the additive fill level(s) may be any marked or unmarked fill level below the top of the siphon post, so as to avoid commencement of siphoning action prior to the desired dispensing time.

After drawer 10 and attached cover 15 are pushed back into drawer compartment 12, and during appropriate times in the wash cycle, water is introduced into chamber 38 (through opening 28) and into chamber 39 (through opening 29). By way of further example, broken line 71 indicates a level of water and fabric softener mixture after water is added to chamber 38. Similarly, broken line 72 indicates a level of water and bleach mixture after water is added to chamber 39. As water is added to chamber 38 and the liquid level rises above the top of siphon post 43 (and thus above the inlet 58 of bore 57), a siphoning effect occurs within a siphon chamber 75 formed between the inner wall of cap 66 and the outer wall of siphon post 43. This siphon effect then draws liquid from chamber 38 and releases that liquid through outlet 59 of bore 57 into cavity 64, with said liquid then flowing from drawer 10 into drawer compartment 12 along bottom 63. Liquid is drawn from chamber 39 in a similar fashion through a siphon chamber 77 formed by cap 67 and siphon post 41.

Figure 5:
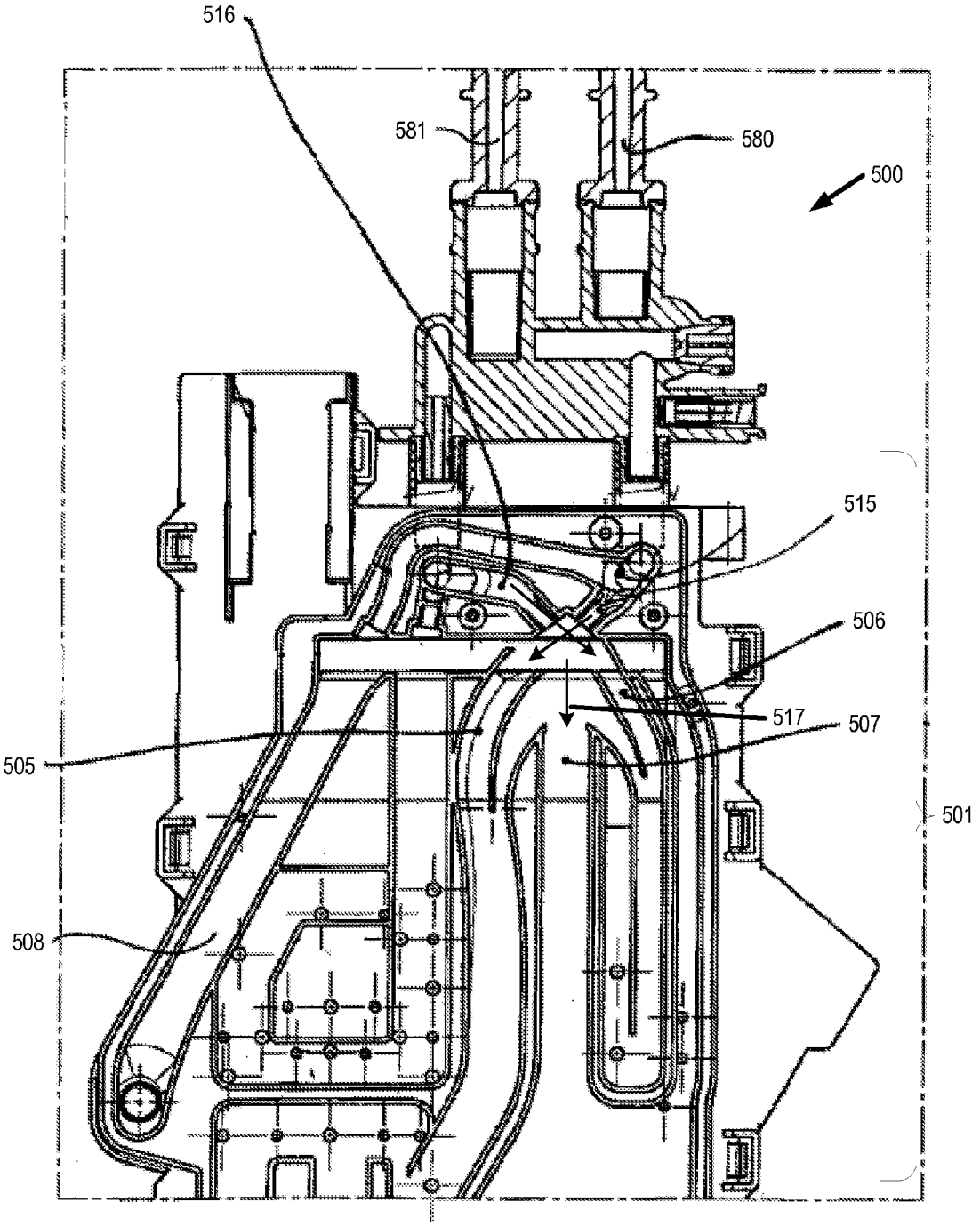
FIG. 5 illustrates a water inlet configuration according to one or more aspects described herein.

FIG. 5 illustrates a water inlet configuration including a water conveying tray, for directing water into an appropriate chamber of the dispenser drawer 10 (FIG. 2). For example, water inlet configuration 501 may be implemented as part of water flow control assembly 31 of FIGS. 2-4. Tray 500 includes multiple water dispensing paths 505, 506 and 507 that lead to different additive chambers. In particular, water dispensing path 505 directs water into a detergent chamber such as chamber 35 of FIG. 3, path 506 directs water into a bleach chamber, e.g., chamber 39 of FIG. 3, and dispensing path 507 directs water into a fabric softener chamber such as chamber 38 of FIG. 3. Additionally, dispensing path 508 is used to direct water to a water bypass that allows water to flow directly into a wash tub (e.g., tub 3 of FIG. 1) without mixing with an additive. Water is able to flow into each of the various chambers through groupings of holes in the water flow control assembly above each chamber (as discussed previously).

Water flow may be directed down an appropriate path by selectively activating one of more of inlet nozzles 580 and 581 connected to the water flow control assembly. Nozzles 580 and 581 may include conduits, such as conduits 515 and 516, that direct the delivered water in a certain direction (e.g., directions indicated by the illustrated arrows). In order for the assembly to deliver water in direction 517 and down channel 507, the streams from nozzles 580 and 581 may be collided to produce a single stream running in direction 517. Such a known arrangement advantageously permits elimination of a third water control valve and nozzle. In some instances, however, unintentional flow of water may result. For example, unintended flows may result from fluctuations in water pressure flowing from one or more of the inlet nozzles. In such instances, the water flowing down one or more unintended paths will collect in one or more corresponding chambers. Since the unintentional flow of water down the one or more unintended paths is typically relatively small, the level of water collected in the corresponding chamber(s) often does not reach a siphon activation level (i.e., the siphon post head). An undesirable result is that a user will often find residual liquid present in a chamber after the wash cycle is complete and/or the next time the user loads wash additives.

Figure 6:
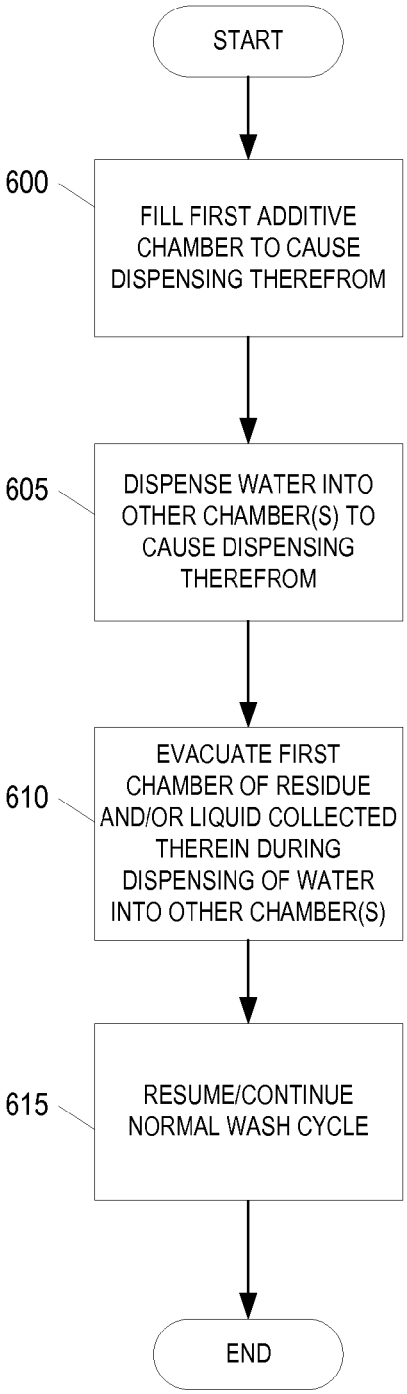
FIG. 6 is a flowchart illustrating a sequenced water delivery process for dispensing multiple additives and evacuating liquid collected in one chamber during a water flow into another chamber.

To compensate for the unintended collection of water in a chamber, a sequential water delivery process, as illustrated by the flowchart of FIG. 6, may be used. In step 600, a first additive chamber may be filled with water down a first inlet path to cause dispensation of a liquid/additive mixture from the chamber. For example, during a rinse cycle, water may be dispensed into a fabric softener chamber to dilute and add fabric softener to the wash. In step 605, water may be dispensed into one or more other chambers (e.g., a detergent chamber or a bleach chamber) to cause dispensing therefrom. The amount of water delivered into the one or more other chambers may be defined based on an amount of water needed to initiate a siphoning effect in the one or more other chambers. In one or more configurations, a percentage of the water originally intended for a different wash cycle may be reserved for use in evacuating the one or more other chambers. For example, a wash system may reserve 10% of the amount of water originally designated for a fabric softener chamber or cycle, and use that water later for evacuating one or more other chambers with unintended collections of water or other residue. This water allocation scheme allows for the use of the features described herein while using the same overall amount of water in the wash cycle or phase. Alternatively, water used for flushing one or more chambers may be independent of the amounts of water used for other cycles or phases of the wash process.

In step 610, the first chamber may be evacuated by flowing water into the first chamber to cause any water or additive residue collected therein to be flushed away. The evacuation may result from siphoning taking effect and/or other evacuation mechanisms. Liquid may collect in first chamber due to the filling and dispensing of the one or more other chambers. Once evacuated, the wash cycle may continue or resume in step 615.

Further, in one or more configurations, a wash system may include one or more sensor components for detecting when water or residue is unintentionally present in one or more of the chambers at any given time, in which case, the described process for flushing such a chamber may be carried out conditionally, dependent upon a sensor output.

As mentioned, in addition to removing the unintended collection of water, the evacuation process discussed in FIG. 6 also aids in drawing out additive residue that may remain in the various chambers. For example, a powder detergent in the detergent chamber might not have been fully flushed out during the main wash cycle. Accordingly, some of the powder detergent may have been left as a residue on the bottom of the detergent chamber. Flushing or evacuating the detergent chamber a second time helps to eliminate such residue and keep the detergent chamber tidy. Such flushing away of additive residue may also enhance the operation of the siphon draw assemblies, by preventing restriction or clogging thereof by additive residue.

The invention has been described in terms of particular exemplary embodiments. Numerous other embodiments, modifications and variations within the scope and spirit of the appended claims will occur to persons of ordinary skill in the art from a review of this disclosure.

We claim:

1. A method for delivering water in a wash cycle, the method comprising:

in a washing apparatus, dispensing a first wash additive into a wash chamber of the washing apparatus by delivering water into a first wash additive storage chamber;

dispensing a second wash additive into a wash chamber of the washing apparatus by delivering water into a second wash additive storage chamber, wherein the delivering water into the second wash additive storage chamber causes an unintended flow of water into the first additive storage chamber; and flushing the first wash additive storage chamber to remove the unintended flow of water by delivering water into the second wash additive storage chamber to activate a siphoning effect within the first additive storage chamber.

2. The method of claim 1, wherein the dispensing the first wash additive is performed during a first wash cycle, and the dispensing the second wash additive is performed during a second wash cycle following the first wash cycle.

3. The method of claim 2, wherein the flushing of the first wash additive storage chamber is performed during the second wash cycle.

4. The method of claim 3, wherein the flushing occurs after the dispensing of a second wash additive.

5. The method of claim 1, wherein the flushing flushes from the first wash additive storage chamber additive residue remaining therein after the dispensing the second wash additive.

6. The method of claim 1, wherein the washing apparatus is a laundry washing machine.

7. The method of claim 1, wherein the delivery of water in the dispensing and flushing steps are carried out using a water distribution tray overlying a drawer containing the first and second wash additive storage chambers.

8. The method of claim 7, wherein the delivery of water in the dispensing and flushing steps is carried out by flowing water down first and second water delivery pathways of the water distribution tray, the first and second water delivery pathways leading to the first and second storage chambers, respectively.

9. The method of claim 8, wherein the flowing of water is carried out using a plurality of water inlet nozzles directing water into the water distribution tray.

10. The method of claim 9, wherein water is directed to a pathway leading to the second wash additive storage chamber by colliding streams from at least two of the plurality of inlet nozzles.

11. The method of claim 10, wherein a portion of the water from the collided streams flows into the first wash additive storage chamber.

12. A method for delivering water in a washing apparatus during a wash cycle, the method comprising:

delivering water into a first additive storage chamber to thereby cause dispensing of a first liquid/additive mix therefrom;

after causing the dispensing of the first liquid/additive mix from the first additive storage chamber:

delivering water into a second additive storage chamber to thereby cause dispensing of a second liquid/additive mix therefrom, wherein delivering the water into the second additive storage chamber includes colliding a plurality of water streams, and wherein colliding the plurality of water streams during dispensing of the second liquid/additive mix causes an unintended flow of water into the first additive storage chamber; and flushing the first additive storage chamber to remove the unintended flow of water by delivering a defined amount of water into the first additive storage chamber using a non-collided water stream, wherein delivering the defined amount of water into the first additive storage chamber activates a siphoning effect within the first additive storage chamber to remove the unintended flow of water.

13. The method of claim 12 further comprising delivering water into a drawer including the first and second additive storage chambers.

14. The method of claim 12 further comprising directing water to a water delivery channel leading to the second additive storage chamber by colliding streams of water from at least two water inlet nozzles.

15. The method claim 12, wherein the siphoning effect is generated via a siphon post disposed in the first additive storage chamber.

16. The method of claim 12, wherein the amount of water used for flushing the first wash additive storage chamber is reserved from a total amount of water intended for use in dispensing the second liquid/additive mix to the wash chamber.

17. The method of claim 12 further comprising detecting when water or residue is present in the first additive storage chamber, wherein the flushing the first additive storage chamber in performed in response to the detecting when water or residue is present in the first additive storage chamber.

* * * * *